US006676767B2

(12) United States Patent
Chang et al.

(10) Patent No.: US 6,676,767 B2
(45) Date of Patent: Jan. 13, 2004

(54) APPARATUS AND METHOD FOR REMOVING CONDENSATE FROM PIPES

(75) Inventors: Chih-Tien Chang, Hsinchu (TW); Newton Wang, Hsin-Chu (TW); Sheng-Liang Pang, Hsinchu (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 34 days.

(21) Appl. No.: 10/152,937

(22) Filed: May 22, 2002

(65) Prior Publication Data

US 2003/0217763 A1 Nov. 27, 2003

(51) Int. Cl.[7] ..... B08B 9/02

(52) U.S. Cl. ..... 134/8; 134/42; 15/104.05; 15/104.16

(58) Field of Search ..... 134/8, 9, 22.1, 134/23, 42; 15/104.03, 104.05, 104.16

(56) References Cited

U.S. PATENT DOCUMENTS 2,206,006 A * 6/1940 Hendrey ..... 73/324
2,267,435 A * 12/1941 Thomas ..... 15/304
2,812,921 A * 11/1957 Leith, Jr. ..... 254/134.5
3,839,085 A * 10/1974 Hulvey et al. ..... 134/8
6,158,074 A * 12/2000 Castille ..... 15/88
6,395,098 B1 * 5/2002 Holmes ..... 134/8
6,408,936 B2 * 6/2002 Duran ..... 165/94

* cited by examiner

*Primary Examiner*—Randy Gulakowski
*Assistant Examiner*—Saeed Chaudhry
(74) *Attorney, Agent, or Firm*—Tung & Associates

(57) ABSTRACT

The present invention provides an improved apparatus and method for removing condensates, such as chlorides, from a dry etch, vacuum effluent stream. Dry etching of metallizations under vacuum conditions, using RF plasma and other techniques, is used in the processing of semiconductor devices and other applications. The apparatus and method remove accumulated chloride deposits that would otherwise restrict and ultimately plug the pipe that carries the vacuum effluent stream. The present invention utilizes an inner tube that is placed on the interior of the pipe and magnetically coupled to an outer tube that surrounds the exterior of the pipe. Translation of the outer tube causes translation of the inner tube, thereby removing accumulated condensate from the pipe. The apparatus may be configured so as to sense the accumulation of the condensate and automatically actuate the apparatus to remove the accumulated condensate.

15 Claims, 3 Drawing Sheets

APPARATUS AND METHOD FOR REMOVING CONDENSATE FROM PIPES

BACKGROUND OF THE INVENTION

Field of the Invention

This invention relates generally to an apparatus and method for removing metal chloride condensate, such as condensable aluminum chloride vapor, that is being exhausted through the exhaust lines of a dry metal etching system in order to control the build-up of such condensate and prevent the eventual clogging of vacuum pump lines, valves, and other components downstream from the etching system. The invention comprises an apparatus that may be automatically translated through the interior of such lines to remove accumulated condensate. Further, the apparatus may be configured so as to sense the accumulation of the condensate and automatically actuate the apparatus to remove the accumulated condensate.

In a typical aluminum etching process for producing components for semiconductor devices, a silicon wafer or other substrate having a film of aluminum on its top surface is positioned in a reaction chamber, and the chamber is evacuated to a vacuum of about 10 millitorr using various well-known vacuum pumping mechanisms, such as for example, a combination of a turbo pump and a mechanical vacuum pump which are connected to the reaction chamber via a foreline. A photoresist that defines the desired metallization pattern is placed on the aluminum surface to protect part of the aluminum film. The exposed part of the aluminum film that is not protected by the photoresist is then removed by etching through the introduction of a low pressure, reactive, chlorine-containing gas such as chlorine ($Cl_2$) or boron trichloride ($BCl_3$). Typically, the etching reaction is plasma-enhanced, where the reaction between the chlorine-containing gas and the aluminum film is enhanced by applying radio frequency (RF) power to the reaction chamber to create a plasma comprising the atomic constituents of the reactive gas in high energy states in the chamber. The generation of the plasma also causes the reaction chamber to heat up, typically to a temperature of 100 to 150° C. The plasma-assisted reaction between the aluminum film and the chlorine-containing reaction gas etches aluminum from the exposed areas of the aluminum film, resulting in the formation of a condensable aluminum chloride vapor ($AlCl_3$) reaction byproducts. The reaction chamber effluent, which contains the condensable aluminum chloride vapor in addition to excess chlorine-containing reaction species, is removed from the reaction chamber by the application of a vacuum using well-known vacuum pumping techniques. An exhaust line 2 leading from the vacuum pump then directs the effluent 4 to a scrubber 6, where the condensable aluminum chloride vapor and any excess chlorinated reaction gases are collected as shown in FIG. 1. A wet scrubber employing water is often employed to combine the gaseous aluminum chloride vapor and excess chlorinated reaction gas effluent with water to produce various aqueous species that can be treated using well-known waste treatment methods.

The condensable chloride byproduct in the conventional aluminum etching systems described above cause problems downstream from the reaction chamber, because they condense, solidify, and deposit upon contact with cool surfaces, such as the cooler interior surfaces of the vacuum forelines and exhaust lines that are used to convey the effluent gas away from the reaction chambers, as well as in other components of the vacuum conduit system of the etching system. As shown in FIG. 2, a buildup of solid aluminum chloride 8 downstream from the etching chamber can partially or even entirely clog the pipes.

As shown in FIG. 3, it is well known to heat the vacuum conduit 2 used to exhaust the reaction chamber using a heater, such as heating tape 10, to prevent the condensation of the gaseous species 4 created in the etching reaction. For example, typically, the vacuum in the foreline of an aluminum etching system is approximately 500 millitorr, and consequently it is necessary to heat the vacuum conduit to a temperature of about 70° C. in order to keep condensable species, such as aluminum chloride vapor, in the vapor phase so that they can be removed from the chamber and the foreline by the applied vacuum. However, the pressure in the exhaust line between the pump and the scrubber is typically much higher, for example 760 torr, and therefore it is necessary to heat the exhaust lines to even higher temperatures, typically around 105° C., to keep the condensable aluminum chloride vapor in the vapor phase as the effluent flows through the exhaust lines. In addition, in the region adjacent to the scrubber 6, there is also typically a partial pressure of water vapor available for the etching reaction by-products to react with, yielding additional condensable reaction products that can condense and clog the exhaust lines. If either the foreline, the exhaust line, or both are not maintained at the proper temperature, the condensable species 8 will cool, condense, and solidify, and species such as condensed aluminum chloride solids will build up along the interior surfaces of the vacuum conduit system, resulting in the diminished function or clogging of the vacuum source.

Additional measures used to control the buildup of solid aluminum chloride in vacuum forelines and exhaust lines in vacuum systems of etching systems are known, including various forms of traps. However, since it is difficult to maintain all parts of an entire vacuum conduit system of an aluminum etching system at the proper temperature to ensure that condensation does not occur, or to efficiently trap condensable etching by-products with conventional traps, the buildup of solid aluminum chloride will inevitably occur throughout the vacuum conduit system of an aluminum etch system, particularly near the interface with the wet scrubber. Consequently, in spite of the heating jackets, heating tape, and various types of traps already available, there is still a need for an improved apparatus and method to prevent the accumulation of condensable species.

SUMMARY OF THE INVENTION

The present invention is an apparatus for removing deposits from a pipe, comprising: a reversible drive means; a drive screw having a longitudinal axis, said drive screw located adjacent to an exterior surface of the pipe such that a longitudinal axis of the pipe and the longitudinal axis of the drive screw are substantially parallel, said drive screw rotatably attached to said drive means; a ball nut that is translatably affixed to said drive screw, said ball nut having an anti-rotation means for limiting the rotation of the ball nut in conjunction with rotation of the ball screw; a first tube that is fixedly attached to said ball nut and capable of being magnetized, said first tube adapted to be translated over an outer surface of the pipe and having a longitudinal axis that is substantially parallel to the longitudinal axis of the pipe; a second tube that is adapted to be translatably positioned on the interior of the pipe and capable of being magnetized having an outer diameter adapted to permit said second tube to be positioned inside the pipe such that an exterior surface of the second tube is adjacent an interior surface of the pipe, and having a longitudinal axis that is substantially parallel to the longitudinal axis of the pipe. Preferably, the drive means is an electric motor. The apparatus may also include a controller, such as a microcomputer controller, for controlling the motor that is in signal communication with said electric motor; a pressure sensor for sensing the pressure in the pipe that is in signal communication with the controller; and at least two position sensors that are adapted to sense the position of the apparatus. The apparatus can sense an increase in the ambient pressure within the pipe and through the controller energize the motor to rotate the ball screw, thereby translating the ball nut and the first tube along the length of the ball screw. The second tube is magnetically attracted to the first tube and is thereby translated inside the pipe in conjunction with the translation of the first tube. The position sensors are used to detect the position of the apparatus through the controller. These position signals may be used to determine the travel limits of the apparatus.

The apparatus described above may be controlled using the method of sensing the ambient pressure within the pipe; communicating a signal indicative of the ambient pressure within the pipe to the controller; monitoring the signal indicative of the ambient pressure within the pipe using the controller so as to identify changes in the ambient pressure; communicating a drive signal from the controller to the drive means in response to a change in the ambient pressure, so as to cause the apparatus to be translated along the pipe; sensing one of the first or second positions using respectively one of the first or second position sensors; communicating a signal indicative of the position of the apparatus to the controller; and communicating a drive signal from the controller to the drive means in response to the signal from the position sensor. The drive signal may be a signal to stop the motor or to cause the motor direction to be reversed. In the case where the motor is reversed, the method may further comprise sensing the other of the first or second positions using respectively the other of the first or second position sensors; communicating a signal indicative of the position of the second tube to the controller; and communicating a drive signal from the controller to the drive means in response to the signal from the position sensor. The steps of the method may be repeated a number of times or cycles until the pressure sensor detects that the pressure in the pipe has returned to a desired ambient pressure and the position sensors indicate that the apparatus is in a desired stop position.

DESCRIPTION OF THE INVENTION

Figure 1:
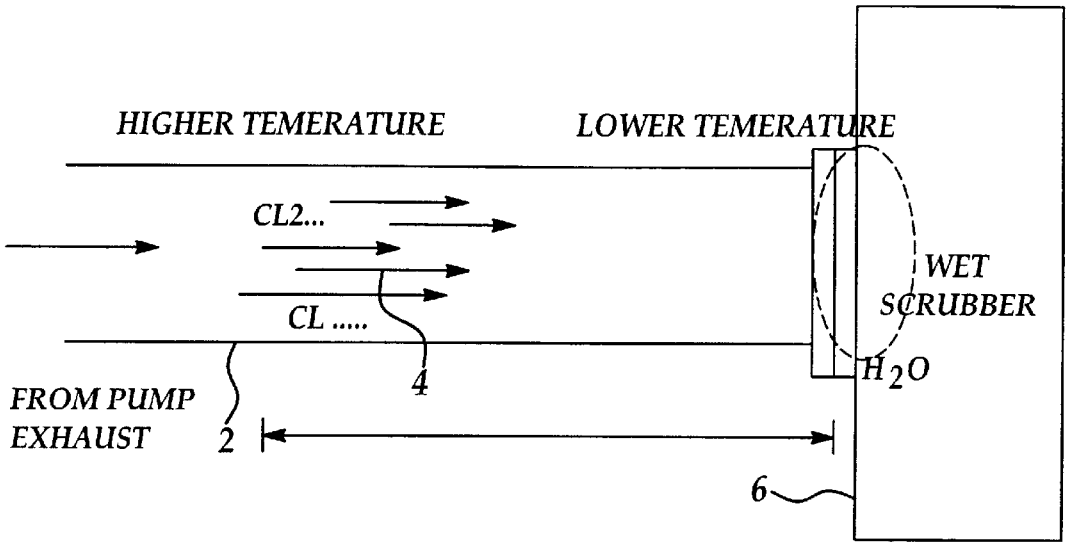
FIG. 1 is a schematic description of some of the elements of a typical etching exhaust system that includes a wet scrubber to remove various by-products of the etching process.
Figure 2:
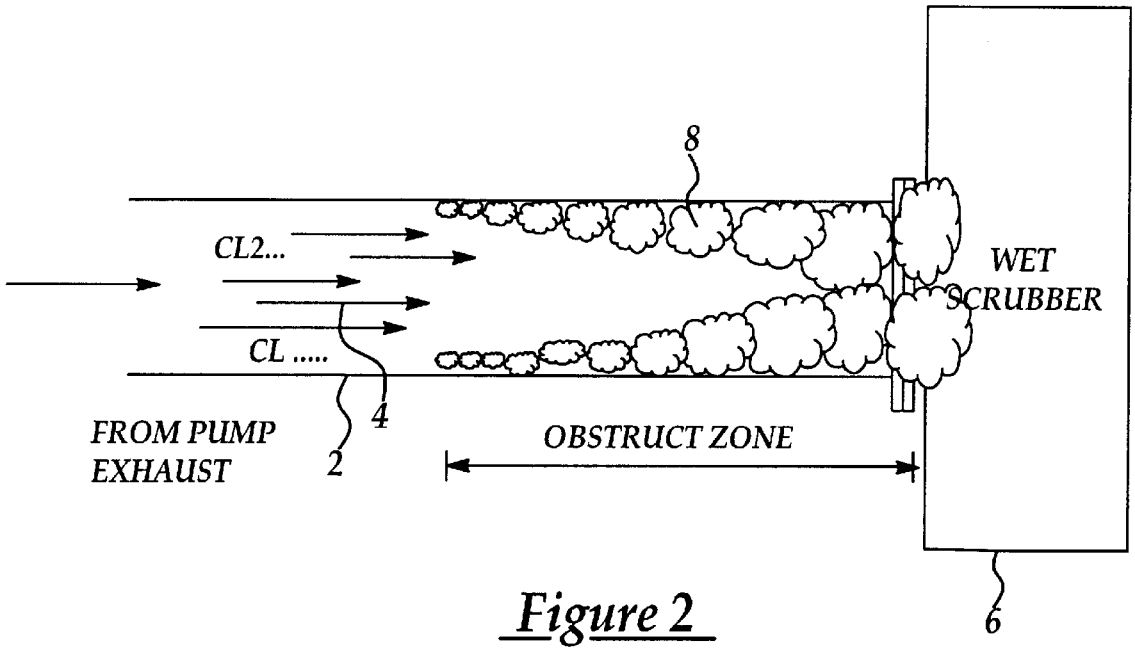
FIG. 2 is a schematic illustration of the accumulation of various etching by-products in a typical etching exhaust system during use of the system.
Figure 3:
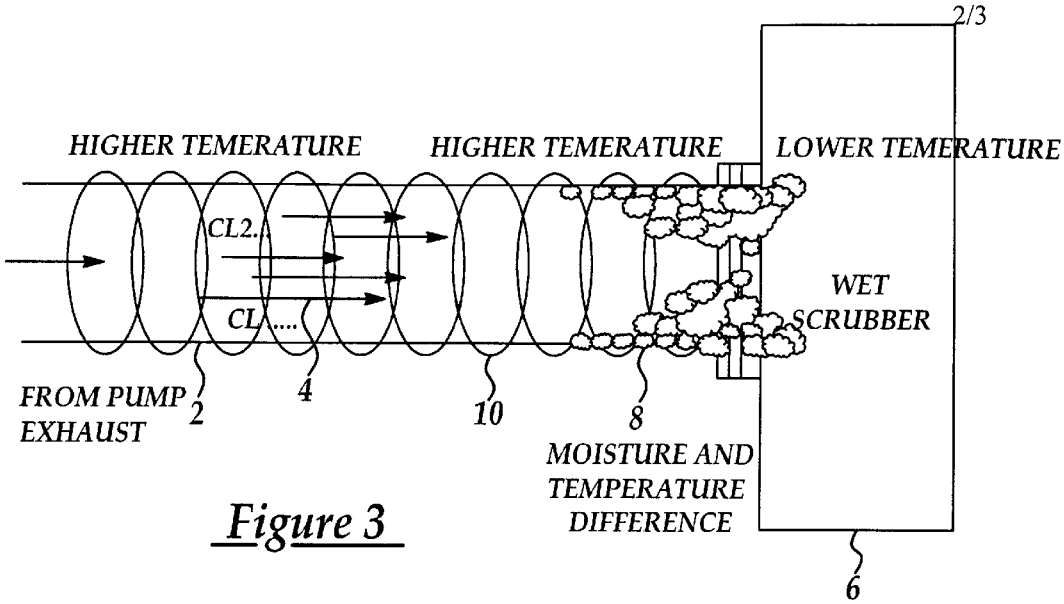
FIG. 3 is a prior art apparatus for preventing the accumulation of etching by-products.
Figure 4:
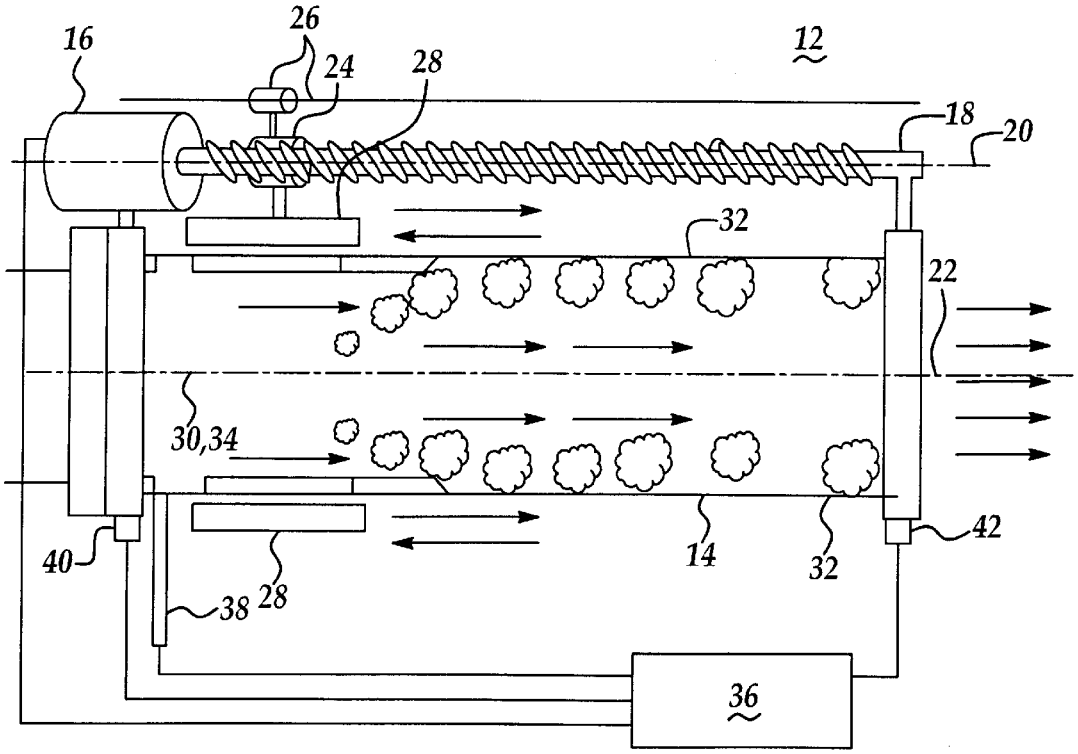
FIG. 4 is a cross-sectional view of the apparatus of the present invention.

Referring to FIG. 4, the present invention comprises an apparatus 12 for removing deposits from a pipe 14, tube or similar structure. The present invention is preferably suitable for removing condensed etching by-products from a vacuum conduit of a dry etching system of the type described above, but is not so limited. It is believed to be generally applicable for the removal of deposits from pipes 12, tubes or similar structures. As described above, the apparatus of the present invention is particularly suited for use in a vacuum conduit of a dry etching system in a region immediately adjacent the connection between the vacuum conduit and a scrubber used for the accumulation and treatment of the etching by-products, such as a wet scrubber, where condensation of the etching by-products is most likely to occur. Since vacuum conduits of the type referred to herein are typically assembled in flanged sections, it is preferred that the elements of the apparatus be assembled to a flanged section of pipe 14 of a length sufficient to encompass the portion of the conduit system that is most susceptible to the accumulation of the condensed etching by-products. It is also preferred that the elements of the apparatus be arranged so as to remove the condensed etching by-products by pushing them into the scrubber, or alternately, into a trap such that they may be removed from the vacuum conduit system. Pipe 14 is preferably a non-magnetic material, including various non-metallic materials, such as glass or ceramic, but may also comprise various non-magnetic metals.

Referring again to FIG. 4, apparatus 12 comprises a reversible drive means 16. Reversible drive means 16 is preferably an electric motor, but other suitable reversible drive means may be used, such as a hydraulic motor, or a combination of a reversible electric motor, drive belt or chain, and pulley arrangement. Reversible drive means 16 is rotatably connected to drive screw 18. By rotatably connected, it is meant to include all manner of connection of drive screw 18 that permits the transmission of the rotational energy of the motor to be coupled to drive screw 18, including all manner of fixed connections, as well as various forms of clutches that would limit the amount of energy transmitted to drive screw 18. Drive screw 18 is preferably a ball screw of a type well known in the art. Drive screw 18 has a longitudinal axis and is located adjacent to an exterior surface of pipe 14 such that a longitudinal axis 22 of pipe 14 and longitudinal axis 20 of drive screw 18 are substantially parallel. As used herein, substantially parallel means sufficiently parallel considering the engineering tolerances of the related elements of apparatus 12 so as to permit the movement of the apparatus without undue parasitic losses due to misalignment of these elements. The end of drive screw 18 opposite reversible drive means 16 is supported by a bearing (not shown) or other mechanism known in the art sufficient to permit the free rotation of the screw while also providing support to that end of drive screw 18.

Apparatus 12 also comprises ball nut 24 of a type well known in the art that is translatably affixed to drive screw 18. Ball nut 24 has an anti-rotation means 26 for limiting the rotation of ball nut 24 in conjunction with rotation of ball screw 18. The anti-rotation means may be any suitable means, such as a bushing or bearing that is affixed to the ball nut and an associated guide rod having a longitudinal axis that is substantially parallel to longitudinal axis 20 of ball screw 18.

A first tube 28 is fixedly attached to ball nut 24 and capable of being magnetized. First tube may be a permanent magnet or an electromagnet. First tube 28 is adapted to be translated over an outer surface of pipe 14 and has longitudinal axis 30 that is substantially parallel to longitudinal axis 22 of pipe 14

Second tube 32 is adapted to be translatably positioned on the interior of the pipe and capable of being magnetized having an outer diameter adapted to permit said second tube to be positioned inside the pipe such that an exterior surface of the second tube is adjacent an interior surface of the pipe, and having longitudinal axis 34 that is substantially parallel to longitudinal axis 22 of pipe 14. Because of the corrosive environment and the need to provide a surface with a low coefficient of friction, second tube 32 preferably comprises a first portion that is adapted to be magnetized, such as iron or steel, and a second portion that encapsulates the first portion to protect the first portion from the corrosive environment and provide a low coefficient of friction relative to the inner surface of pipe 14, such as an engineering thermoplastic or thermoset material. One such material is polytetrafluoroethylene (PTFE).

Figure 4A:
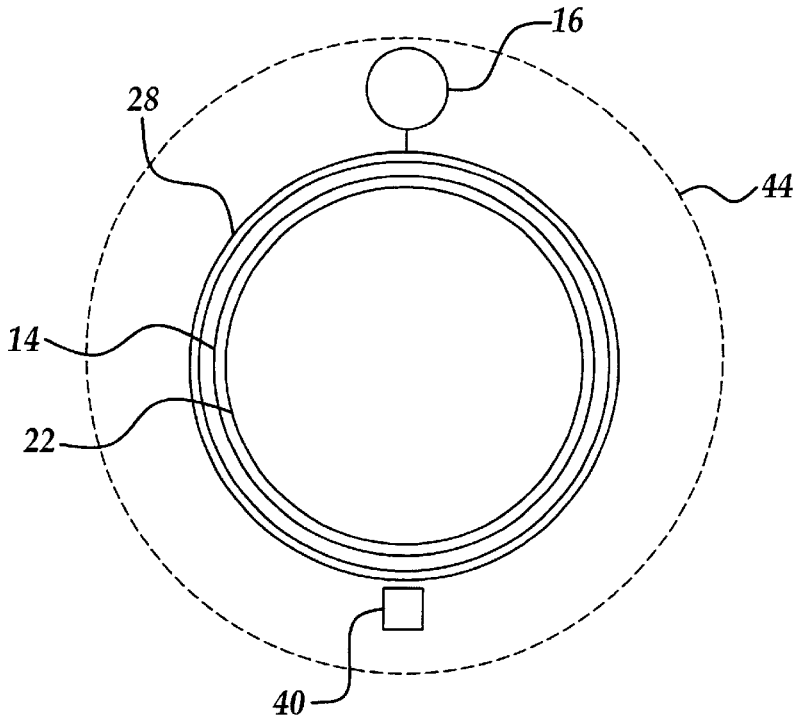
FIG. 4A is a cross-sectional view of the apparatus of FIG. 4 along line AA.
Figure 5:
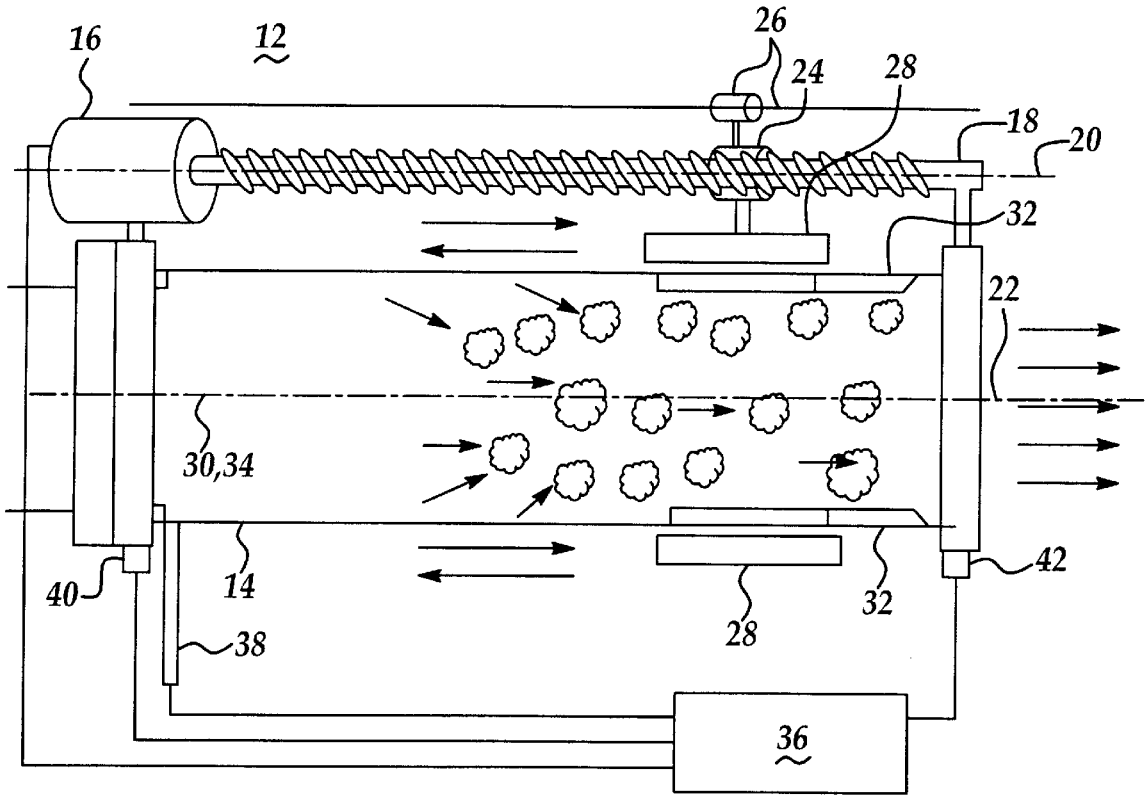
FIG. 5 is a second cross-sectional view of the apparatus of FIG. 4 illustrating the translation of the apparatus.

Referring to FIG. 4A, first tube 28 and second tube 32 must be magnetized in such a way as to be magnetically attracted to one another. This magnetic attraction must be sufficiently strong to maintain a magnetic coupling between first tube 28 and second tube 32 as first tube 28 is translated along pipe 14, taking into consideration the parasitic losses due to friction between the inner surface of pipe 14 and the outer surface of second tube 32, including losses associated with removing accumulated condensate from the inner surface of pipe 14. The apparatus 12 may also be surrounded by a heat jacket 44 of a type known in the art in order to provide additional protection against the accumulation of condensate within the pipe. The elements of the invention described herein will vary in size depending on many factors, including the diameter of pipe 14, the materials used for first tube 28 and second tube 32, and particularly the strength of the magnetic fields between them. However, if pipe 14 has a diameter of 15–20 cm and a zone over which condensation may occur of approximately 30–40 cm, second tube 32 may have a length of approximately 5–10 cm. In addition, it may be desirable to design second tube 32 such that the leading edge, the edge which is oriented toward the portion of pipe 14 where condensation is most likely to occur, is comprised entirely of the material used to encapsulate the magnetic portion to provide additional protection to the magnetic portion.

Apparatus 12 may be operated in variety of modes, including a manual mode, whereby the translation of ball nut 24 and first tube 28 is observed by an operator and the direction of motor 16 is reversed manually when ball nut 24 reaches an end of travel limit. In order to automate the operation of apparatus 12, it may also comprise controller 36, such as a microcomputer controller of a type well known in the art, for controlling the electric motor that is in signal communication with electric motor. Controller 36 is utilized in conjunction with pressure sensor 38 that is in signal communication with controller 36. Pressure sensor 38 is adapted to sense the pressure within pipe 14. Controller 36 should also be utilized in conjunction with at least two position sensors 40, first position sensor 40 and second position sensor 42, that are in signal communication with controller 36, said position sensors are adapted to sense the position of said second tube within pipe 14 and are spaced apart along pipe 14 to define a range of travel of apparatus 12.

One method of automated operation comprises defining predetermined intervals of operation of apparatus 12 within controller 36, for example intervals ranging from 1 to 30 minutes. At the predetermined intervals, apparatus 12 is energized and reversible drive means 16 translates the apparatus along pipe 14 from first position sensor 40 to second position sensor 42. When apparatus 12 reaches second position sensor 40, the direction of rotation of reversible drive means 16 is reversed and apparatus 12 is translated along pipe 14 in the direction of first position sensor 40. When apparatus 12 reaches first position sensor 40, the apparatus may be shut off until the next predetermined interval of operation, or alternately, the method may be repeated for a predetermined number of times or cycles, a cycle being defined as the translation from the first position sensor to the second position sensor and back. The predetermined intervals of operation may be of the same duration, or may be varied according to a predetermined schedule. In addition, the pressure sensor 38 may be utilized to detect the pressure within the pipe 14. If a sensed pressure is detected that is greater than the ambient operating pressure, such as for example a sensed pressure that is $\geqq 10\%$ above the ambient operating pressure, the speed of drive means 16 may be increased to apply more energy toward the removal of the accumulated condensate.

A second method of automated operation comprises: sensing the ambient pressure within pipe 14 with the pressure sensor 38; communicating a signal indicative of the ambient pressure within pipe 14 from the pressure sensor 38 to controller 36; monitoring the signal indicative of the ambient pressure within pipe 14 from pressure sensor 38 using controller 36 so as to identify changes in the ambient pressure; and communicating a drive signal from controller 36 to drive means 16 in response to a sensed pressure that is above the ambient pressure, so as to cause drive means 16 to be energized and apparatus 12 to be translated along pipe 14. As the apparatus is translated along pipe 14, the method may also include sensing one of the first or second positions using respectively the first 40 or second 42 position sensor; communicating a signal indicative of the position of apparatus 12 to controller 36; and communicating a drive signal from the controller to the drive means in response to the signal from the first 40 or second 42 position sensor. At this point, the drive signal may simply be a command to drive means 16 to stop the translation of apparatus 12. Alternately, the method may additionally include: sensing the other of the first or second positions using respectively the other of the first 40 or second 42 position sensors; communicating a signal indicative of the position of apparatus 12 to controller 36; and communicating a drive signal from controller 36 to drive means 16 in response to the signal from the other of the first 40 or second 42 position sensors. This method describes the automatic operation of the apparatus and interaction of its elements as it is translated from one position sensor to the other and back again. This defines one cycle of the apparatus. The method may be repeated for a plurality of cycles as necessary so long as the sensed pressure is above the ambient pressure during which operation, the method may include sensing the pressure in pipe 14 during the operation of apparatus 12; and communicating a drive signal from controller 36 to stop drive means 16 in response to the signal from the position sensor indicating that apparatus 12 is in a desired stop position and a signal from the pressure sensor that the sensed pressure in the pipe is the ambient pressure. While the invention has been described with respect to certain preferred embodiments and exemplifications thereof, these are not intended to limit the scope of the invention thereby, but solely by the claims appended hereto.

What is claimed is:

1. An apparatus for removing deposits from a pipe, comprising:

a reversible drive means;

a drive screw having a longitudinal axis, said drive screw located adjacent to an exterior surface of the pipe such that a longitudinal axis of the pipe and the longitudinal axis of the drive screw are substantially parallel, said drive screw rotatably attached to said drive means;

a ball nut that is translatably affixed to said drive screw, said drive having an anti-rotation means for limiting the rotation of the ball nut in conjunction with rotation of the ball screw;

a first tube that is connected with said reversible drive means and capable of being magnetized, said tube adapted to be translated over an outer surface of the pipe and having a longitudinal axis that is substantially parallel to the longitudinal axis of the pipe; and a second tube that is adapted to be translatably positioned on the interior of the pipe and capable of being magnetized and to be magnetically attracted to said first tube having an outer diameter adapted to permit said second tube to be positioned inside the pipe such that an exterior surface of the second tube is adjacent an interior surface of the pipe, and having a longitudinal axis that is substantially parallel to the longitudinal axis of the pipe.

2. The apparatus of claim 1, wherein said drive means is an electric motor.

3. The apparatus of claim 2, further comprising a controller for controlling said electric motor that is in signal communication with said electric motor.

4. The apparatus of claim 3, further comprising a pressure sensor that is in signal communication with said controller, said pressure sensor adapted to sense the pressure within the pipe.

5. The apparatus of claim 4, further comprising at least two position sensors that are in signal communication with said controller, said position sensors adapted to sense the position of the apparatus and spaced apart along pipe to define a range of travel of the apparatus.

6. The apparatus of claim 1, wherein said second tube comprises a first portion that is adapted to be magnetized and a second portion that encapsulates the first portion.

7. The apparatus of claim 6, wherein the first portion comprises iron or steel, and the second portion comprises an engineering thermoplastic.

8. The apparatus of claim 7, wherein the second portion comprises polytetrafluoroethylene.

9. An apparatus for removing deposits from a pipe, comprising:

a reversible electric motor;

a drive screw having a longitudinal axis, said drive screw located adjacent to an exterior surface of the pipe such that a longitudinal axis of the pipe and the longitudinal axis of the drive screw are substantially parallel, said drive screw rotatably attached to said electric motor;

a ball nut that is translatably affixed to said drive screw, said ball nut having an anti-rotation means for limiting the rotation of the ball nut in conjunction with rotation of the drive screw;

a first tube that is fixedly attached to said ball nut and capable of being magnetized, said tube adapted to be translated over an outer surface of the pipe and having a longitudinal axis that is substantially parallel to the longitudinal axis of the pipe;

a second tube that is adapted to be translatably positioned on the interior of the pipe and capable of being magnetized having an outer diameter adapted to permit said second tube to be positioned inside the pipe such that an exterior surface of the second tube is adjacent an interior surface of the pipe, and having a longitudinal axis that is substantially parallel to the longitudinal axis of the pipe;

a controller for controlling said electric motor that is in signal communication with said electric motor;

a pressure sensor that is in signal communication with said controller, said pressure sensor adapted to sense the pressure within the pipe; and at least two position sensors that are in signal communication with said controller, said position sensors adapted to sense the position of the apparatus and spaced apart along the pipe to define a range of travel of the apparatus.

10. A method of removing deposits from a pipe utilizing an apparatus comprising a reversible drive means for imparting rotation; a drive screw having a longitudinal axis, the drive screw located adjacent to an exterior surface of the pipe such that the longitudinal axis of the pipe and the longitudinal axis of the drive screw are substantially parallel, the drive screw rotatably attached to said drive means; a ball nut that is translatably affixed to the drive screw, the ball nut having an anti-rotation means for preventing the rotation of the ball nut in conjunction with rotation of the ball screw; a first tube that is fixedly attached to said ball nut and capable of being magnetized, said first tube adapted to be translated over an outer surface of the pipe and having a longitudinal axis that is substantially parallel to the longitudinal axis of the pipe; a second tube that is adapted to be translatably positioned on the interior of the pipe and capable of being magnetized having an outer diameter adapted to permit the second tube to be positioned inside the pipe such that an exterior surface of the second tube is adjacent an interior surface of the pipe; a pressure sensor that is in signal communication with a controller, a pressure sensor adapted to sense the pressure within the pipe; a first position sensor and a second position sensor that are each in signal communication with said controller, said first and second position sensors adapted to sense the position of the apparatus and positioned apart from one another so as to define respectively first and second positions and a region within the pipe over which deposits may be removed; comprising:

sensing a ambient pressure within the pipe;

communicating a signal indicative of the ambient pressure within the pipe to the controller;

monitoring the signal indicative of the ambient pressure within the pipe using the controller so as to identify changes in the ambient pressure; and communicating a drive signal from the controller to the drive means in response to a sensed pressure that is above the ambient pressure, so as to cause the apparatus to be translated along the pipe.

11. The method of claim 10, further comprising:

sensing one of the first or second positions using respectively the first or second position sensor;

communicating a signal indicative of the position of the apparatus to the controller; and communicating a drive signal from the controller to the drive means in response to the signal from the first or second position sensor.

12. The method of claim 11, wherein said drive signal reverses the drive means thereby causing the translation of the apparatus toward the other of the first or second position sensors.

13. The method of claim 11, wherein said drive signal stops the translation of the apparatus.

14. The method of claim 11, further comprising repeating the method so long as the sensed pressure is above the ambient pressure.

15. The method of claim 14, further comprising:

sensing the pressure in the pipe during the operation of the apparatus; and communicating a drive signal from the controller to stop the drive means in response to the signal from the position sensor indicating that the apparatus is in a desired stop position and a signal from the pressure sensor that the sensed pressure in the pipe is the ambient pressure.

* * * * *